United States Patent [19]

Phripp et al.

[11] 4,032,997

[45] July 5, 1977

[54] FLUSH TOILET ACCESSORY

[76] Inventors: Clarence F. Phripp, R.R. No. 1, St. Clements, Ontario, Canada, N0B 2M0; Norman R. Preston, 169 Ross Ave., Kitchener, Ontario, Canada, N2A 1V5

[22] Filed: Sept. 23, 1975

[21] Appl. No.: 615,923

[30] Foreign Application Priority Data

Sept. 30, 1974 United Kingdom ..... 42437/74

[52] U.S. Cl. ..... 4/52; 4/DIG. 1; 4/55; 4/57 P; 4/67 A; 4/67 R

[51] Int. Cl.[2] ..... E03D 1/34; E03D 3/12

[58] Field of Search ..... 4/34, 37, 41, 40, 52, 4/57 R, 57 P, 55, 58, 60, 63, 67 R, 67 A, DIG. 1

[56] References Cited

UNITED STATES PATENTS

| | | | |
|---|---|---|---|
| 13,330 | 12/1911 | Guyton | 4/52 |
| 1,128,980 | 2/1915 | Hobble | 4/DIG. 1 |
| 2,168,742 | 8/1939 | O'Neill et al. | 4/67 A |
| 2,214,439 | 9/1940 | Robertson | 4/67 R |
| 2,241,220 | 5/1941 | Powers | 4/DIG. 1 |
| 2,260,078 | 10/1941 | Kurkjian | 4/56 |
| 2,773,268 | 12/1956 | Hurko et al. | 4/57 P |
| 3,142,846 | 8/1964 | Lackenmaier et al. | 4/57 P X |
| 3,156,930 | 11/1964 | Moulton et al. | 4/67 R |
| 3,302,217 | 2/1967 | Schrock | 4/57 P |
| 3,325,828 | 6/1967 | Alexander | 4/57 P |
| 3,345,648 | 10/1967 | Rafferty | 4/67 A |
| 3,553,740 | 1/1971 | Fogg | 4/56 |
| 3,561,016 | 2/1971 | Reynolds | 4/67 A |
| 3,775,778 | 12/1973 | Lee | 4/67 A |
| 3,790,968 | 2/1974 | Pfeifer | 4/67 A |
| 3,908,203 | 9/1975 | Jackson | 4/57 P |
| 3,921,226 | 11/1975 | Macdonald | 4/56 |

*Primary Examiner*—Henry K. Artis
*Attorney, Agent, or Firm*—Sim & McBurney

[57] ABSTRACT

This invention provides a flush regulator for use in a toilet flush tank in order to regulate the outflow from the flush tank through an outlet pipe. The regulator includes a mounting portion from which extends water chamber means open upwardly, and air chamber means open downwardly. The chamber means are symmetrically arranged with respect to the mounting portion.

7 Claims, 7 Drawing Figures

FLUSH TOILET ACCESSORY

This invention relates generally to flush toilets, and has to do particularly with an accessory which may be applied to flush toilets incorporating valve-closed outlets, and which will reduce or restrict the amount of water required per flush.

Many flush toilet designs, particularly on the North American continent, have traditionally provided for a flushing operation in which, most of the time, considerably more water than the minimum necessary is utilized to evacuate the toilet bowl. This traditional design stems from an era in which water was readily and cheaply available.

Currently, however, certain densely populated areas and municipalities are experiencing shortages or curtailment of the water supply, accompanied by rising costs of supplying water, and it would be of advantage to provide some instrumentality by which new and existing flush toilets may be adapted to use a smaller amount of water to evacuate the toilet bowl.

Despite the desirability of utilizing a smaller amount of water to evacuate the toilet bowl, however, it is nonetheless of advantage to be able to employ the standard or full head of water for the flushing action which is provided by the original or traditional design of the reservoir tank. By utilizing the traditional full head of water in the reservoir tank, a strong and vigorous flushing action can be attained.

This invention addresses itself to the foregoing disadvantages of conventional flush toilet design.

Accordingly, this invention provides a flush regulator for use in a toilet flush tank for regulating the outflow therefrom through an outlet pipe, the regulator comprising a mounting portion and upwardly open water chamber means symmetrically disposed about the mounting portion.

In a preferred embodiment of this invention, there is provided a flush regulating assembly for use in a toilet flush tank for regulating the outflow therefrom through an outlet pipe, the assembly including a mounting portion, upwardly open water chamber means symmetrically disposed with respect to the mounting portion, and downwardly open air chamber means symmetrically disposed with respect to the mounting portion.

According to another preferred embodiment of this invention, there is provided a flush regulator assembly for use in a toilet flush tank for regulating the outflow therefrom through an outlet pipe, the assembly comprising: a mounting portion, means supporting the mounting portion from another part of the flush tank such that the mounting portion can move between upper and lower positions in the flush tank, upwardly open water chamber means supported from the mounting portion, downwardly open air chamber means supported from the mounting portion, and means enabling the mounting portion to exert a premature downward push on a valve member adapted to open and close said outlet pipe.

Several embodiments of this invention are illustrated in the accompanying drawings, in which like numerals denote like parts throughout several views, and in which.

General arrangements for all embodiments of this invention are such as to permit an arresting of the transfer of water from the flush tank to the bowl at a point earlier than the normal closure for which the toilet is traditionally designed. In at least one of the embodiments shortly to be described, at the option of the operator, the portion effecting premature closure of the flap valve may be prevented from doing so, whereby a normal full flush may be obtained.

Figure 1:
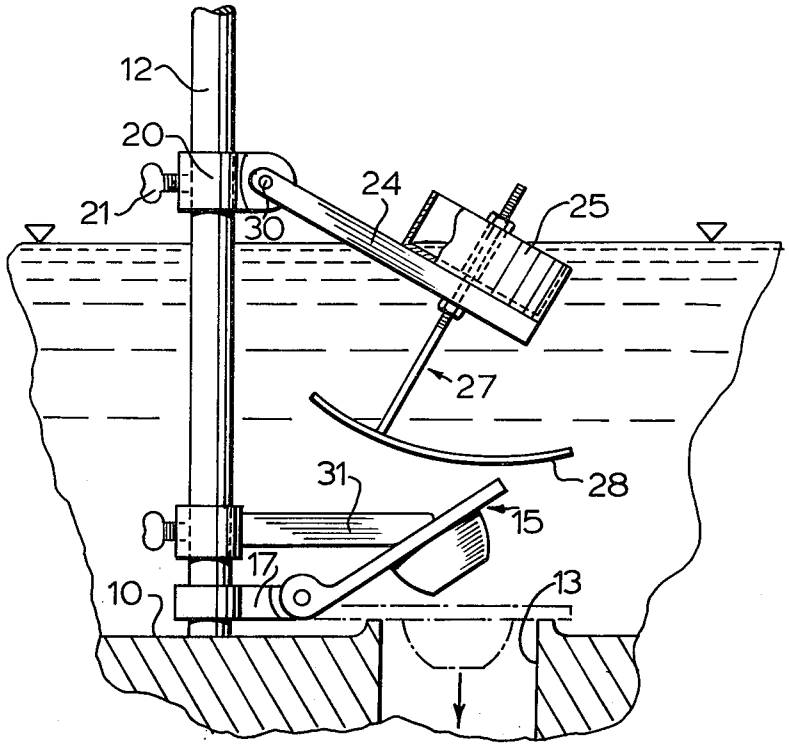
FIG. 1 illustrates a first embodiment of this invention, seen in elevation.

Attention is first directed to FIG. 1, which shows the inside of a toilet tank or reservoir having a bottom 10, an overflow standpipe 12, an outlet pipe 13 and an outlet valve 15 of the flap-valve type. In FIG. 1, the outlet valve 15 is hingedly mounted to a fitting 17 secured to the lower end of the overflow standpipe 12. Adjustably secured to the overflow standpipe 12 at a higher location is a clamp member 20 having a thumb screw 21 for tightening purposes. Hinged to the clamp 20 is an arm 24 on which is mounted a float 25. The arm 24, or a portion thereof, constitutes a weight so that the item 24 and 25 constitute a float/weight combination component. Adjustably mounted on the arm 24 is an extension 27 having a contact foot 28 at the lower end. The extension 27, the float 25, the contact foot 28 and the arm 24 pivot about the point 30 as a unit. When the tank is in the normal full condition, prior to being flushed, the float 25 and the arm 24 are raised upwardly and the extension 27 with its contact foot 28 is also raised up out of the way of the outlet valve 15 in either the closed or open position of the latter. Normal flushing then takes place, and the outlet valve floats up to the position in which it is shown in FIG. 1, this position being set by a flap valve stop 31 secured to the standpipe 12. As the water drains out of the toilet tank through the outlet pipe 13, the arm 24 gradually pivots in the clockwise direction about the pivot point 30 as seen in FIG. 1, and finally the contact foot 28 comes into contact with the outlet valve 15, and the downward pressure resulting from this contact is sufficient to close the outlet valve 15 prior to the point in time when it would normally close. The premature closure prevents the toilet tank from being completely drained, and ensures that the flap valve 15 will close while there is still an appreciable amount of water in the toilet tank. The adjustability of the extension 27 permits an adjustment of this "remaining amount" of water in the toilet tank at the time of closure of the outlet valve 15.

In the normal construction of flush toilets, the flushing chain (not shown in FIG. 1) is attached to an outer portion of the outlet valve 15, so that an upward pull on the chain raises the outlet valve 15 from its seat against the mouth of the outlet pipe 15. With such a construction, it is possible to achieve and maintain a full flush (with all of the water in the toilet tank draining through the outlet pipe 13) by simply holding the operating lever down for the duration of the flush. This will maintain the flushing chain in its tightened position, and will positively support and hold the outlet valve 15 in its open position as seen in FIG. 1. Even when the arm 24 descends so that the contact foot 28 rests against the outlet valve 15, the upward pull on the chain will be sufficient to support the additional weight thereby placed on the outlet valve 15.

Figure 2:
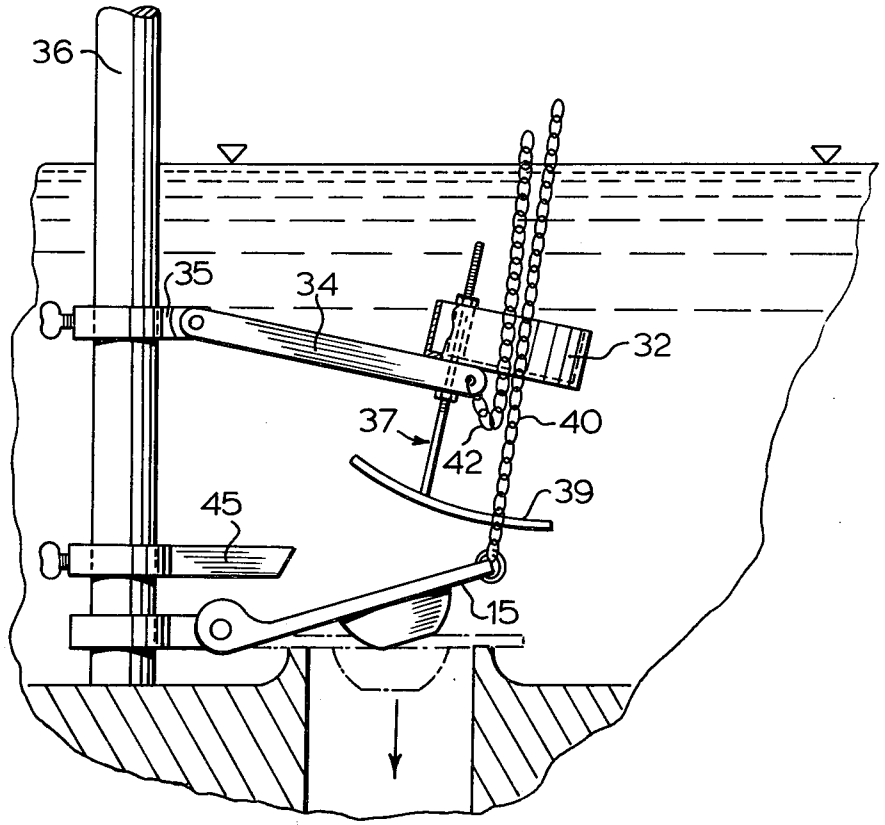
FIG. 2 illustrates a second embodiment of this invention, seen in elevation.

Attention is now directed to FIG. 2, which shows a further embodiment of this invention. In FIG. 2, an assembly is illustrated which permits the immediate optional selection of all or part of the water in the toilet reservoir to flush the toilet bowl. In FIG. 2, a small water chamber 32 is so arranged that the weight of water in the chamber 32 causes premature closing of the outlet valve 15 when a mini-flush is selected. The selection of a full flush will cause an emptying of the chamber 32, which in turn will allow normal closing of the outlet valve 15.

The water chamber 32 is mounted below the water level on an arm 34 which is hinged to a clamp 35, which in turn is mounted on the overflow standpipe 36 or other suitable fixed portion of the toilet reservoir. The arm 34 is floated to achieve neutral buoyancy of the hinged assembly. An adjustably mounted extension 37 is fastened to the arm 34 in such a way that when the hinged arm rotates downwardly (in the clockwise sense as seen in FIG. 2), the extension 37 contacts the outlet valve 15 by virtue of a contact foot 39. A chain 40 of the conventional kind is provided to open the outlet valve 15. An additional chain 42 is also provided, this one being attached to a point on the arm 34 remote from its pivoted leftward end. The chain 42 is adapted to raise the hinged arm 34 when the operating lever is fully depressed. An outlet valve stop 45 is provided to determine the open position of the outlet valve 15 to ensure that the outlet valve will be in a position to be contacted by the contact foot 39 of the extension 37.

To obtain a partial flush with the configuration of FIG. 2, the operating lever is depressed only part way down. The two chains are so adjusted that the outlet valve 15 will be opened by the conventional chain 40 while the secondary chain 42 remains slack and does not raise the hinged arm 34. As the water level drops, the floating hinged arm 34 and water chamber 32 descend until the correctly adjusted extension with its contact foot 39 touches the outlet valve 15. As the water continues to drop, the full water chamber emerges from the surface and its weight is then transferred to the outlet valve through the extension and the contact foot 39, which causes the outlet valve 15 to close prematurely. As the reservoir refills, the hinged arm 34 and the full water chamber 32 return to their initial position.

To obtain a complete flush using all of the water in the toilet reservoir, the operating lever is fully depressed. This opens the outlet valve 15 in the usual manner, and also raises the hinged arm 34 by virtue of the auxiliary chain 42, in order to raise and empty the water chamber 32. The arm then floats on the surface of the water and descends along with the water level until the extension contacts the outlet valve. With the water chamber 32 empty, there is insufficient weight to close the outlet valve 15 prematurely and a full flush is thereby obtained. As the water level rises the hinged arm and water chamber are raised, the water chamber 32 refills and the hinged arm and water chamber return to their initial position.

Figure 3:
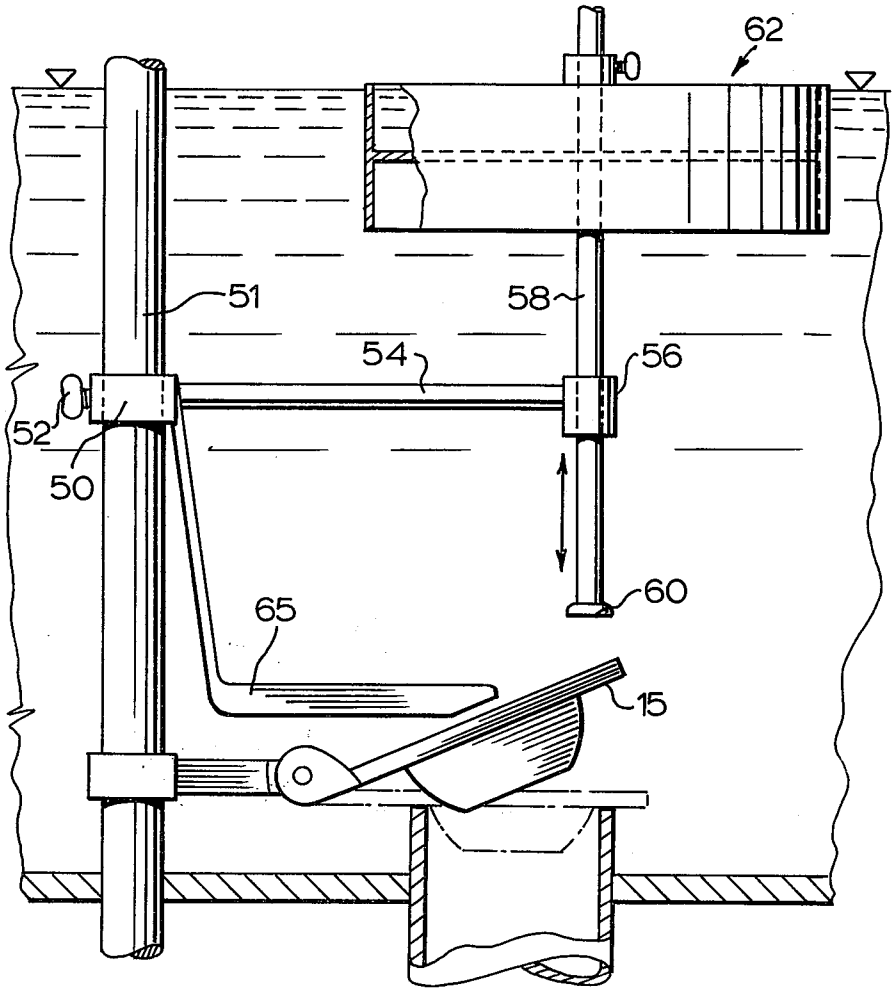
FIG. 3 illustrates a third embodiment of this invention, seen in elevation.

Attention is now directed to FIG. 3, which illustrates a third embodiment of this invention. In FIG. 3, a clamp 50 is adjustably secured to an overflow standpipe 51 by means of a thumb screw 52. Extending outwardly from the clamp 50 is a rigid brace member 54 which supports a slide collar 56 at its rightward end. Mounted for sliding vertical reciprocation within the slide collar 56 is a rod member 58 having a contact portion 60 at the bottom, and having a weight/float member 62 adjustably secured to its upper end. The weight/float member consists of a horizontally partitioned chamber adapted to hold water in its upper compartment and air in its lower compartment. The member 62 will therefore tend to float in the toilet reservoir. A stop member 65 may also be attached to the clamp 50, to prevent the outlet valve 15 from opening beyond a position in which it may be contacted by the portion 60.

Basically, the operation of the apparatus in FIG. 3 is designed to result normally in a mini-flush. In order to cause this apparatus to yield a full flush, the operating handle must be held down so that the outlet valve 15 is forcefully retained in the upward or "open" position shown in FIG. 3.

Figure 4:
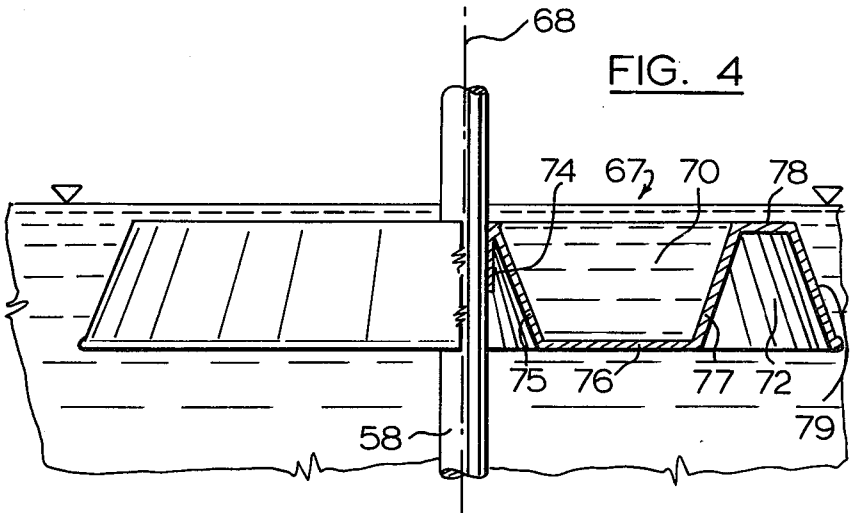
FIG. 4 is a view partly in elevation and partly in vertical section of the air and water chambers of a fourth embodiment of this invention.

FIG. 4 shows the fourth embodiment of this invention, which constitutes a component which may advantageously be utilized in several applications as will hereinafter appear. In particular, the component illustrated in FIG. 4 may be substituted for the component 62 in FIG. 3. The component shown in FIG. 4, which may be termed a regulator, is particularly advantageous because it may be formed as a single, integral stamping or injection mold from suitable material such as plastic or soft metal. Thus, FIG. 4 illustrates a flush regulator 67 which is radially symmetrical about the center axis 68, and has the section shown in hatched lines in the righthand half of FIG. 4. At left in FIG. 4, the flush regulator 67 is shown in elevation. As seen at the right in FIG. 4, the flush regulator 67 includes and defines an annular water chamber 70 and an annular air chamber 72. Both of these chambers are concentric, i.e. the chamber 72 annularly surrounds the chamber 70 in a concentric manner. The water-holding and air-holding functions of the chambers 70 and 72 respectively are related to the fact that chamber 70 opens upwardly, whereas chamber 72 open downwardly. It will be appreciated that, by inverting the regulator 67, the functions of the two chambers may be reversed.

To permit the flush regulator 67 to be secured to the rod 58, a mounting portion in the form of a collar 74 may be provided, adapted snugly and frictionally to surround and grip the rod 58.

In a preferred form of this invention, it is of advantage to ensure that the volume of the air chamber is substantially equal to or less than that of the water chamber. In the flush regulator shown in FIG. 4, this can be accomplished by providing the chambers in such a way that they have the same depth (vertical dimension) and such that, in general terms, the radial breadth of the annular chamber 72 is less than one-half the radius of the chamber 70. Chamber 70 can be considered to have a "radius" if it is viewed as a circular chamber with the collar 74 merely constituting a central boss. It will be appreciated from what follows that it is not essential to have the collar 74 and associated structure upstanding from the center of the chamber 70, and that it could just as easily extend downwardly as viewed in FIG. 4, so long as the collar or equivalent portion were in substantially leak-free contact with the rod 58, so that chamber 70 could hold water.

Referring now more specifically to FIG. 4, the particular shape of the flush regulator 67 therein disclosed is seen to include the collar 74 already described which is adapted to receive and grip rod 58, a downwardly diverging conical wall 75 which may be considered to be part of the collar, a first annular wall 76 which extends outwardly from the collar portion constituted by the cylindrical collar 74 and the conical wall 75 in a plane perpendicular to the collar (i.e. perpendicular to the central axis 68 of the flush regulator), a first frusto-conical wall 77 extending obliquely outwardly from the outer edge of the first annular wall 76, the first frusto-conical wall 77 being upwardly diverging, a second annular wall 78 extending out from the outer edge of the first frusto-conical wall 77 in a plane perpendicular to the collar 74 (i.e. perpendicular to the axis 68), and a second frusto-conical wall 79 extending obliquely outwardly from the outer edge of the second annular wall 78, specifically in a downwardly diverging direction. Thus, the frusto-conical walls 77 and 79 are opposite in their directions of divergence.

It will thus be seen that the chamber 70, which although described as annular above may also be considered circular, is defined primarily by the first annular wall 76 and the first frusto-conical wall 77, since neither the collar 74 nor the conical wall 75 need necessarily extend upwardly into the chamber 70. Likewise, the air chamber 72 may be considered to be defined by the first frusto-conical wall 77, the second annular wall 78, and the second frusto-conical wall 79.

Figure 5:
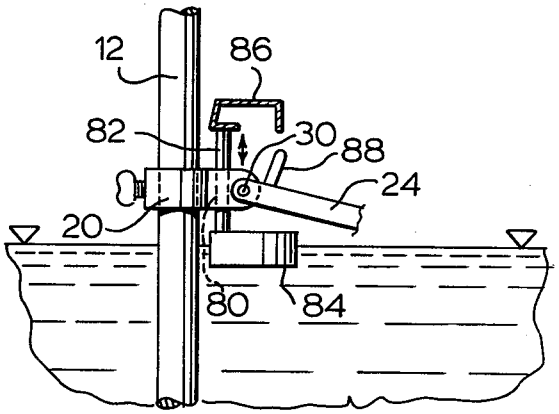
FIG. 5 is a side view of an improvement employable with some embodiments of this invention.

Attention is now directed to FIG. 5, which shows an optional arrangement for some embodiments, by which a full flush may be obtained with a considerable reduction in the time during which the operator must hold the operating lever down.

As shown in FIG. 5, a vertical slideway 80 is provided on the clamp 20 in the vicinity of the pivot point 30. A sliding member 82 is mounted for free vertical reciprocation through the slideway 80. An auxiliary float 84 is fastened to the lower end of the sliding member 82 at a location close to the high water level. At the other or upper end of the sliding member 82 is fastened an inverted cup-like rigid member 86 which can be seen in FIG. 5 in section. A small latch pin 88 is added to the arm 24 in such a position that the latch pin 88 falls just within the periphery of the inverted cup-like rigid member 86 when the arm 24 is in its uppermost position as supported by the float 25 (see FIG. 1).

Depression and immediate release of the operating lever of the flush toilet will allow the arm 24 (FIG. 1) to lower and rotate clockwise and thereby move the latch pin 88 outside or beyond the periphery of the inverted cup-like rigid member 86 before the latter descends sufficiently on its own float 84 to engage the latch pin 88. The action as described with reference to FIG. 1 then continues to provide a mini-flush.

Depression of the operating lever of the flush toilet and a brief holding of the operating lever in the depressed condition for 1 or 2 seconds at the beginning of the flush will allow the auxiliary float 84 to lower the inverted cup-like rigid member 86 while the latch pin 88 remains within the periphery of the rigid member 86, because the arm 24 (FIG. 1) will be held in its uppermost position by the depression of the operating lever. When the operating lever is released in order to permit the arm 24 to rotate clockwise, such clockwise movement of the arm 24 is prevented due to the fact that the latch pin is within the periphery of the cup-like rigid member 86, and thus any further lowering of the arm 24 is prevented. The weight and the other portions attached to the arm 24 are thus supported and are prevented from causing permature closure of the outlet valve 15, and for this reason a full flush occurs.

Figure 6:
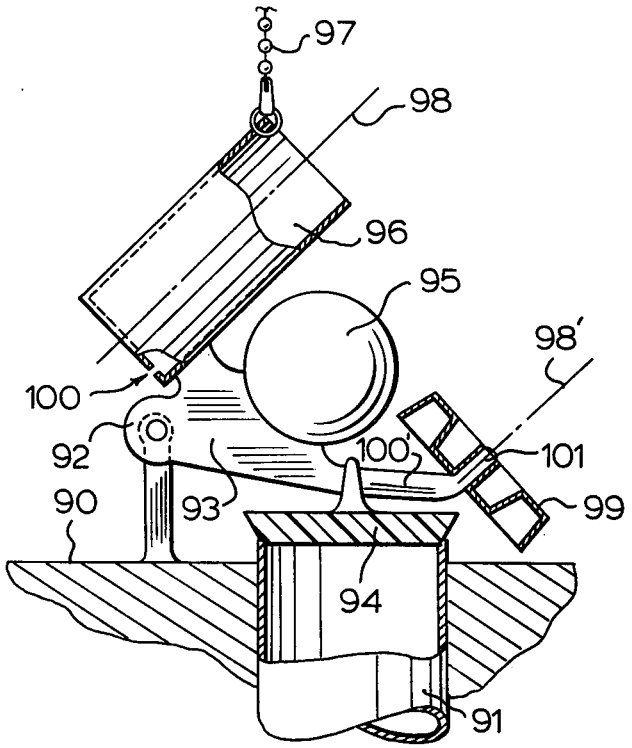
FIG. 6 is an elevational view, partly in section, illustrating a special use of the fourth embodiment of this invention.

Attention is now directed to FIG. 6, which illustrates a particular adaptation of the fourth embodiment of this invention shown in FIG. 4 to a conventional flushing assembly. In FIG. 6, the bottom wall of a flush tank is shown by the numeral 90, with an outlet pipe 91 therethrough. A pivot 92 supported upwardly from the wall 90 allows an arm 93 to undergo pivoting movement. The arm 93 supports an elastomeric valve member 94 which is adapted to open and close the outlet pipe 91. The arm 93 also supports a fully enclosed and sealed air chamber 95, and an upwardly open cylindrical water chamber 96. A chain 97 is provided to permit the operator to pull upwardly on the arm 93, thus moving it counterclockwise with respect to the pivot 92. Counterclockwise motion raises the elastomeric valve member 94 from the outlet pipe 91, and permits the initiation of the flushing procedure. In the normal operation of the apparatus shown in FIG. 6 (i.e. without the addition of the flush regulator shown in FIG. 4 of this disclosure), an upward pull on the chain 97 raises the elastomeric valve member 94 to initiate flushing action, and the air chamber 95 is sufficiently buoyant to continue to rise and thereby rotate the entire pivoting structure once the upward pull on the chain has initiated the action. A stop is arranged near the pivot to halt the rotation when the axis 98 of the water chamber is near the vertical. In this limiting position the water in the chamber 96 forms a counterweight which holds the rotatable structure in position as the water level in the tank drops below the raised float 95, i.e, the "holding" force shifts from buoyancy to gravity. A bleed hole 100 is provided in the bottom of the water chamber 96 to reduce the counterweight (shortly after the tank has drained completely) and allow the assembly to fall back to the original position at which valve 94 seals the outlet pipe.

The parallel lines 98 and 98' represent parallel central axes of the cylindrical water chamber 96 and of a flush regulator 99 constructed substantially as illustrated in greater detail in FIG. 4. The central axes 98, 98' are in a nearly vertical orientation when the valve member 94 is "open", with the arm 92 rotated to its furthest counter-clockwise position.

If it is now imagined that the arm 93 were in its counterclockwise position, with the axes in a nearly vertical orientation it will be realized that as the water level lowers in the flush tank, the reducing weight of water in the emerging water chamber 96 will be counterbalanced by the fact that the flush regulator 99 also gathers and retains water as it emerges from the water surface. This additional amount of water will increase the downward counterclockwise force exerted on the arm 93, and thus cause the same to close earlier than it normally would. An arm 100' having an oblique, pin-like end 101 is provided, and is adapted to support the flush regulator 99 in its appropriate position and orientation, and is also adapted to be secured to the arm 93.

Figure 7:
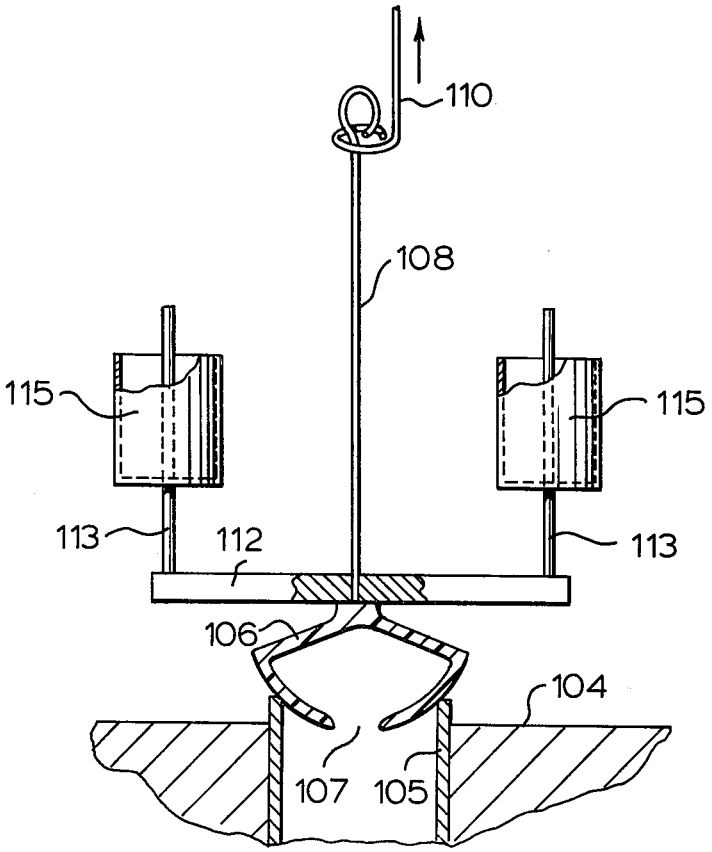
FIG. 7 illustrates the fifth embodiment of this invention.

Attention is now directed to FIG. 7, for a description of the fifth embodiment of this invention.

In FIG. 7, the numeral 104 identifies the bottom wall of a flush tank, having the standard outlet pipe 105 therethrough. Adapted to open and close the outlet pipe 105 is a standard ball-type float valve 106 which is hollow in its interior, but which is downwardly open by virtue of a central bottom opening 107. The float valve 106 is attached to the bottom of a vertical stem 108 which is adapted to receive an upward pull from a pull wire 110 to raise the float valve 106 from the outlet pipe 105. The remaining mechanism involved in the lifting of the float valve 106 from the outlet pipe 105 is conventional, and need not be described or shown in detail.

A mounting bar 112 is affixed in gripping relationship to the vertical stem 108, and extends outwardly therefrom in two directions. Adjacent its opposed ends, the mounting bar supports two upwardly extending rods 113, on each of which is disposed a substantially cylindrical cup member 115, which is open upwardly and closed at the bottom. Either the grip connection between the cup member 115 and the respective rod 113 or the grip connection between the bar 112 and the vertical stem 108 may be made adjustable, in order to permit the operator to select the degree of foreshortening of the normal flush occurring in the toilet.

The combination of the bar 112 and the upwardly extending rods 113 may be considered to constitute arm means supporting the cup-members 115 in diametrically opposite positions with respect to the bar 112, which in turn can be considered to constitute a mounting portion for mounting the entire additional assembly to the vertical stem 108.

Returning briefly to the construction shown in FIG. 3, it will of course be appreciated that the weight/float member 62 may also be arranged with the water compartment and air compartment reversed. This could be brought about by providing a wall or partition at the top and another wall or partition at the bottom of the member 62, along with intermediate entry ports so that liquid will enter and fill up the bottom half. It will be understood that a configuration in which the air chamber were located above the water chamber would constitute a stable element with its centre of floatation located above its centre of gravity.

What we claim is:

1. A flush regulator assembly for use in a toilet flush tank for regulating the outflow therefrom through an outlet pipe, the assembly comprising:

a mounting portion, first means supporting the mounting portion from another part of the flush tank such that the mounting portion can move between upper and lower positions in the flush tank, upwardly open water chamber means connected to the mounting portion, downwardly open air chamber means connected to the mounting portion, and second means enabling the mounting portion to exert a premature downward push on a valve member adapted to open and close said outlet pipe, said second means including an elongated member oriented substantially vertically and adapted to slide freely up and down while constrained against lateral movement within the flush tank, the elongated member having a lower end adapted to push downwardly against said valve member when the latter is in its open position, said mounting portion being attached to the elongated member and being adjustable vertically with respect thereto.

2. The invention claimed in claim 1, in which said second means enabling the mounting portion to exert a premature downward push includes an elongated member oriented substantially vertically and adapted to slide freely up and down while constrained against lateral movement within the flush tank, the elongated member having a lower end adapted to push downwardly against said valve member when the latter is in its open position, said mounting portion being attached to the elongated member and being adjustable vertically with respect thereto.

3. The invention claimed in claim 1, in which said valve member is hollow and opens downwardly, and constitutes said downwardly open air chamber means; the first and second means both including a valve stem to which said mounting portion is secured such that it is vertically adjustable with respect thereto.

4. a flush regulator for use in a toilet flush tank for regulating the outflow therefrom through an outlet pipe, the regulator comprising:

a mounting portion adapted to receive and grip a rod which, when so gripped, extends along a given axis, a first chamber concentrically disposed about said mounting portion and being defined by a first wall extending outwardly and a second wall extending so as to define with the first wall a cup-like shape which opens in one direction with respect to said axis, and a second chamber concentrically disposed about said first chamber and being defined by said second wall in combination with further wall means extending outwardly and then in the direction reversed from the direction of the second wall, to define an annular chamber which opens in the opposite direction from the first chamber.

5. The regulator claimed in claim 4, which further includes a rod gripped by said mounting portion and guide means for holding said rod within a flush tank in substantially vertical orientation such that the rod can reciprocate freely vertically, one of said chambers opening upwardly and being a water chamber, the other of said chambers opening downwardly and being an air chamber.

6. The regulator claimed in claim 5, in which the volume of the air chamber is equal to or less than the volume of the water chamber.

7. The regulator claimed in claim 4, in which said mounting portion is a collar member, said first wall extending perpendicularly to said given axis, said second wall being frusto-conical and extending outwardly and upwardly from the outer edge of the first wall, said further wall means including a third wall of annular shape extending out from the outer edge of the second wall and a fourth wall of frusto-conical shape extending obliquely outwardly and downwardly from the outer edge of the third wall, the volume of the second chamber being equal to or less than the volume of the first chamber.

* * * * *